US010873123B2

(12) United States Patent
Liang et al.

(10) Patent No.: US 10,873,123 B2
(45) Date of Patent: Dec. 22, 2020

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Chia-Ming Liang, New Taipei (TW); Jin-Bo Chen, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 16/523,113

(22) Filed: Jul. 26, 2019

(65) Prior Publication Data

US 2020/0036085 A1 Jan. 30, 2020

(30) Foreign Application Priority Data

Jul. 27, 2018 (CN) ..... 2018 1 0841074

(51) Int. Cl.
*H01Q 1/24* (2006.01)
*H01Q 5/335* (2015.01)

(52) U.S. Cl.
CPC ..... *H01Q 1/243* (2013.01); *H01Q 5/335* (2015.01)

(58) Field of Classification Search
None
See application file for complete search history.

(56) References Cited

U.S. PATENT DOCUMENTS

2018/0026337 A1* 1/2018 Chen ..... H01Q 5/378 343/702
2018/0026354 A1* 1/2018 Lin ..... H04M 1/026 343/702
2019/0181155 A1* 6/2019 Li ..... H01L 27/3272
2019/0252764 A1* 8/2019 Liao ..... H01Q 5/378

FOREIGN PATENT DOCUMENTS

CN 106229674 A 12/2016
CN 107645034 A 1/2018

* cited by examiner

*Primary Examiner* — Anh Q Tran
(74) *Attorney, Agent, or Firm* — ScienBiziP, P.C.

(57) ABSTRACT

An antenna structure utilizing as radiating elements only the metal frame of an electronic device includes a metal frame, a feeding portion, and a ground point. The metal frame defines a first gap and a second gap. The metal frame forms a radiating portion, a first coupling portion, and a second coupling portion through the first gap and the second gap. When the feed supplies current, the current flows through the radiating portion and, being coupled to the first coupling portion and second coupling portion through the first and second gaps, first, second, and third operating modes at different frequencies can be invoked to generate wireless signals in first, second, and third LTE-A frequency bands.

16 Claims, 6 Drawing Sheets

ANTENNA STRUCTURE AND WIRELESS COMMUNICATION DEVICE USING THE SAME

FIELD

The subject matter herein generally relates to antennas and wireless communications.

BACKGROUND

Antennas receive and transmit wireless signals at different frequencies, such as signals in Long Term Evolution Advanced (LTE-A) frequency bands. The antenna structure is complicated and occupies a large space in the wireless communication device, which hinders the miniaturization of the wireless communication device.

Therefore, there is room for improvement within the art.

BRIEF DESCRIPTION OF THE DRAWINGS

Implementations of the present disclosure will now be described, by way of embodiment, with reference to the attached figures.

DETAILED DESCRIPTION

Figure 1:
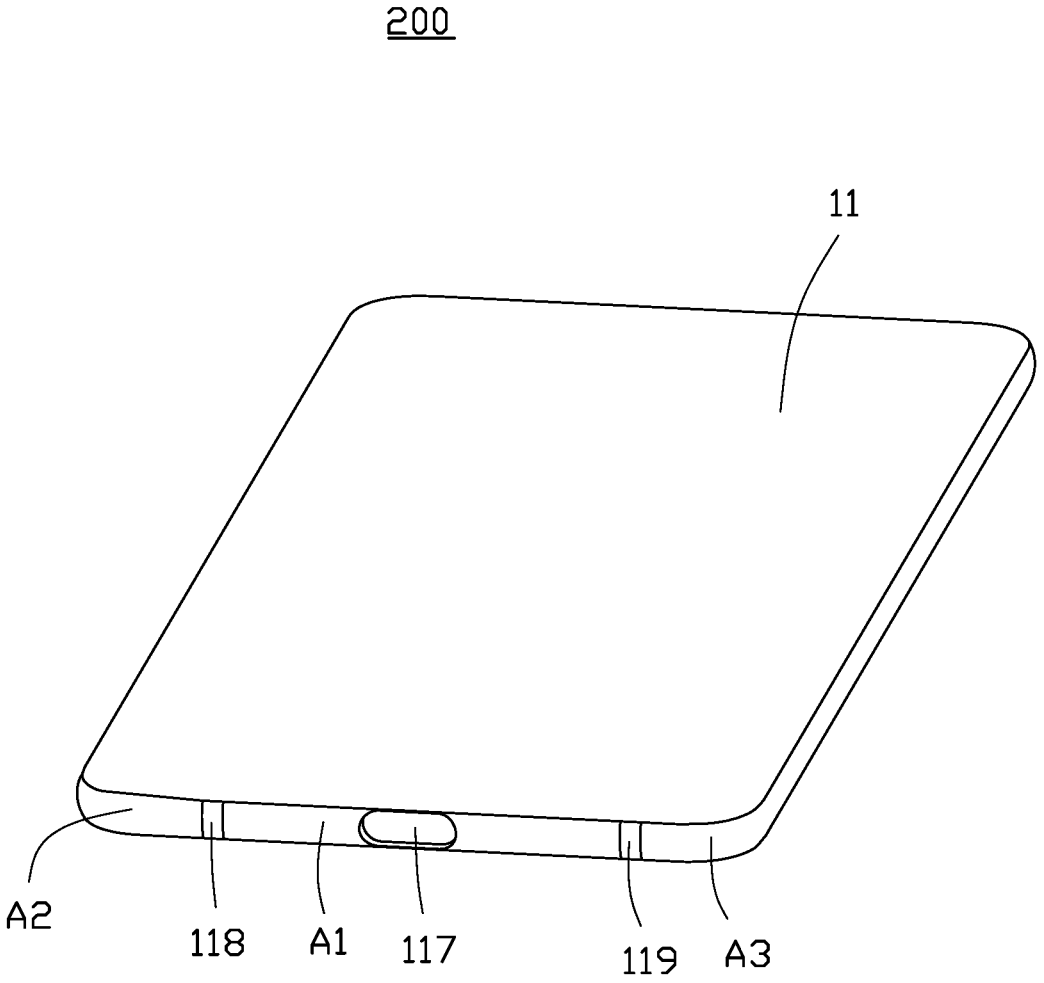
FIG. 1 is an isometric view of an embodiment of an assembled wireless communication device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using the same.

Figure 2:
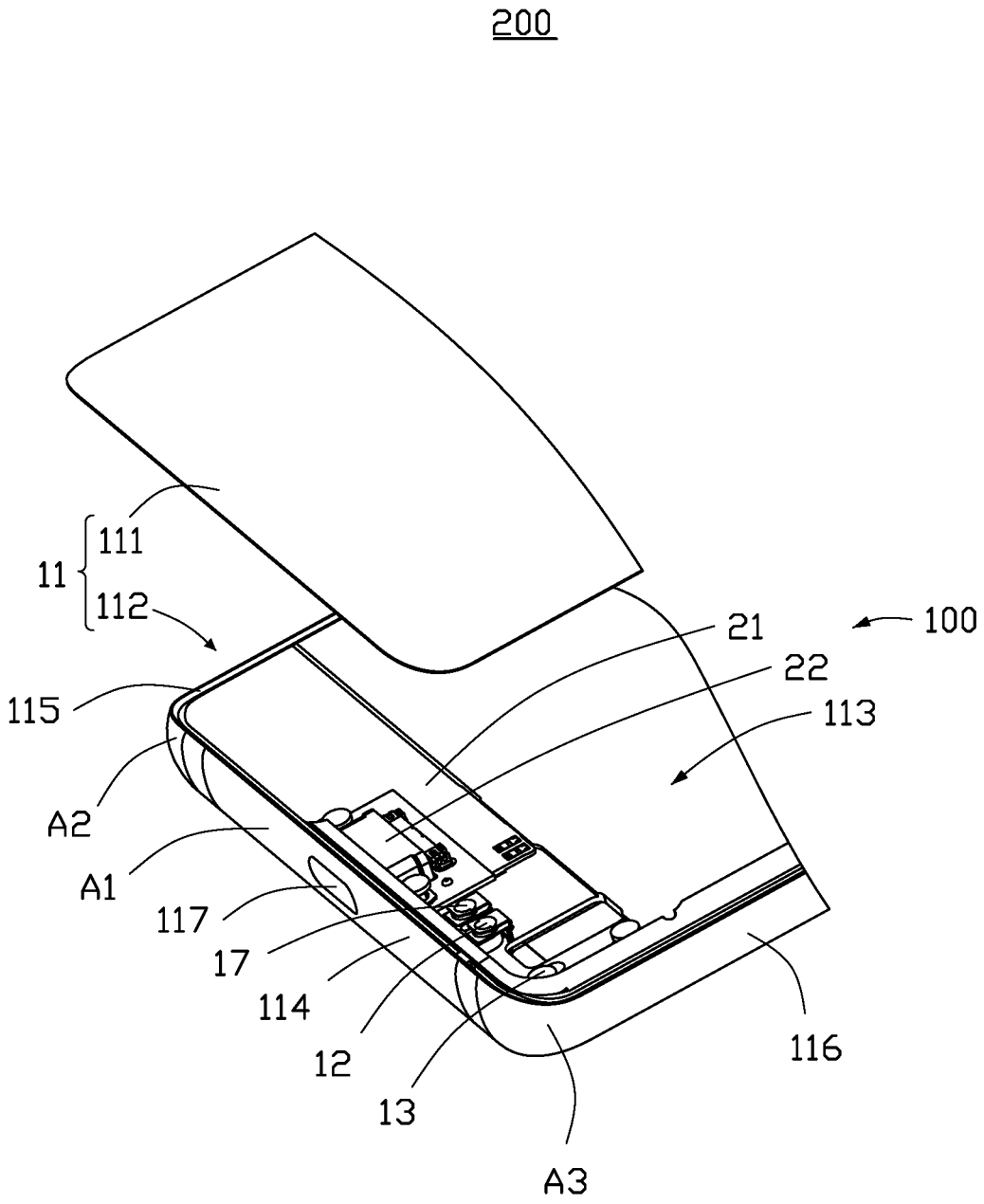
FIG. 2 is an isometric view of an embodiment of an antenna in the wireless communication device of FIG. 1.

FIG. 1 and FIG. 2 illustrate an embodiment of a wireless communication device 200 using an antenna structure 100. The antenna structure 100 can receive and transmit wireless signals. The wireless communication device 200 can be, for example, a mobile phone or a personal digital assistant.

Figure 3:
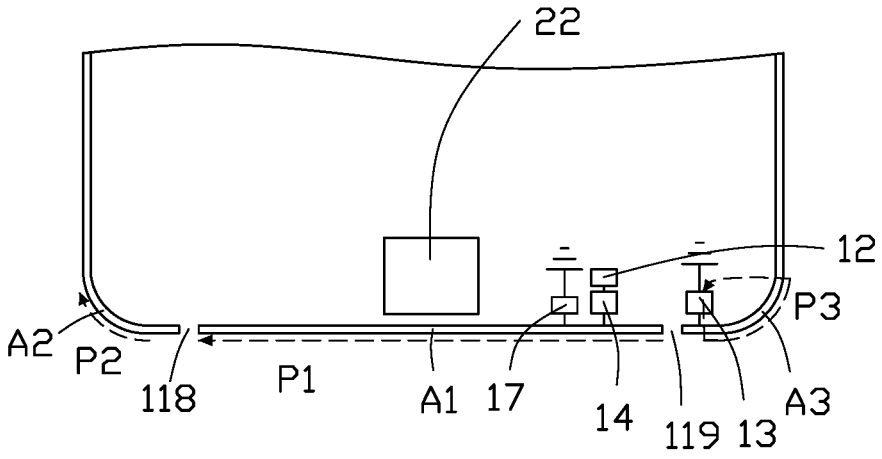
FIG. 3 is a circuit diagram of the antenna structure of FIG. 2.

Referring to FIG. 3, the antenna structure 100 includes a housing 11, a feeding portion 12, a ground point 13, and a matching circuit 14. The housing 11 can be an outer shell of the wireless communication device 200. The housing 11 includes at least one backboard 111 and a side frame 112. In an embodiment, the backboard 111 is made of non-metallic material, such as plastic, glass, or ceramic. The side frame 112 is made of metallic material. The backboard 111 and the side frame 112 together form an outer shell of the wireless communication device 200.

The side frame 112 is substantially annular. In an embodiment, the side frame 112 is positioned around a periphery of the backboard 111. The side frame 112 forms a receiving space 114 together with the backboard 111. The receiving space 113 is configured to receive a printed circuit board (PCB), a processing unit, and other electronic components or modules of the wireless communication device 200.

In an embodiment, the side frame 112 at least includes an end portion 114, a first side portion 115, and a second side portion 116. In an embodiment, the end portion 114 is a bottom portion of the wireless communication device 200. The first side portion 115 is spaced apart from and parallel to the second side portion 116. The end portion 114 has first and second ends. The first side portion 115 is connected to the first end of the end portion 114 and the second side portion 116 is connected to the second end of the end portion 114. In an embodiment, the first side portion 115 and the second side portion 116 are perpendicularly connected to the end portion 114. The end portion 114, the first side portion 115, and the second side portion 116 are all perpendicularly connected to the backboard 111. The end portion 114, the first side portion 115, and the second side portion 116 are integral with the backboard 111.

The side frame 112 further defines an opening 117, a first gap 118, and a second gap 119. In an embodiment, the opening 117 is defined at a middle position of the end portion 114 and passes through the end portion 114. In an embodiment, the first gap 118 is defined at the side frame 112 between the opening 117 and the first side portion 115. The second gap 118 is defined at the side frame 112 between the opening 117 and the second side portion 116. Each of the first gap 118 and the second gap 119 are positioned at a side of the opening 117.

The wireless communication device 200 further includes a substrate 21 and at least one electronic element 22. In an embodiment, the substrate 21 can be a PCB made of epoxy resin glass fiber (FR4) or the like. In an embodiment, the electronic element 22 is a Universal Serial Bus (USB) module. The electronic element 22 is received in the receiving space 113 adjacent to the substrate 21. The electronic element 22 is electrically connected to the substrate 21. In an embodiment, the electronic element 22 corresponds to the opening 117 and is thus partially exposed from the opening 117. A USB device can be inserted in the opening 119 and be electrically connected to the electronic element 23 for charging and data transmission.

In an embodiment, the first gap 118 and the second gap 119 both pass through and extend cross the side frame 112. The first gap 118 and the second gap 119 divide the side frame 112 into three portions including a radiating portion A1, a first coupling portion A2, and a second coupling portion A3. The radiating portion A1 exists in a portion of the side frame 112 between the first gap 118 and the second gap 119. The first coupling portion A2 exists in a second portion of the side frame 112, which extends from a side of the first gap 118 away from the radiating portion A1 and the first gap 118. The second coupling portion A3 exists in a portion of the side frame 112, which extends from a side of the second gap 119 away from the radiating portion A1 and the second gap 118. In an embodiment, the first side portion 115 and the second side portion 116 are both grounded. The first coupling portion A2 and the second coupling portion A3 are both grounded.

In an embodiment, the first gap 118 and the second gap 119 are filled with insulating material to insulate the radiating portion A1, the first coupling portion A2, and the second coupling portion A3. The insulating material can be, but is not limited to, plastic, rubber, glass, wood, ceramics, etc.

The feeding portion 12 is positioned in the receiving space 113. The feeding portion 12 is electrically connected to the radiating portion A1 by the matching circuit 14 and supplying current to the radiating portion. When the feeding portion 12 supplies current, the current flows to the radiating portion A1, and the current is then coupled to the first coupling portion A2 through the first gap 118 and the current is coupled to the second coupling portion A3 through the second gap 119. Thus, the feeding portion 12, the radiating portion A1, the first coupling portion A2, and the second coupling portion A3 form a coupling-feed antenna, which can be activated in a first operating mode, a second operating mode, and a third operating mode. Radiation signals can be respectively generated in a first frequency band, a second frequency band, and a third frequency band.

In an embodiment, a frequency of the third frequency band is higher than a frequency of the second frequency band. A frequency of the second frequency band is higher than a frequency of the first frequency band. The first operating mode is an LTE-A low frequency operating mode. The second operating mode is an LTE-A middle frequency operating mode. The third operating mode is an LTE-A high frequency operating mode. In an embodiment, the first frequency band is about LTE-A 699 MHz-960 MHz. The second frequency band is about LTE-A 1710 MHz-2170 MHz. The third frequency band is about LTE-A 2300 MHz-2690 MHz.

Figure 4:
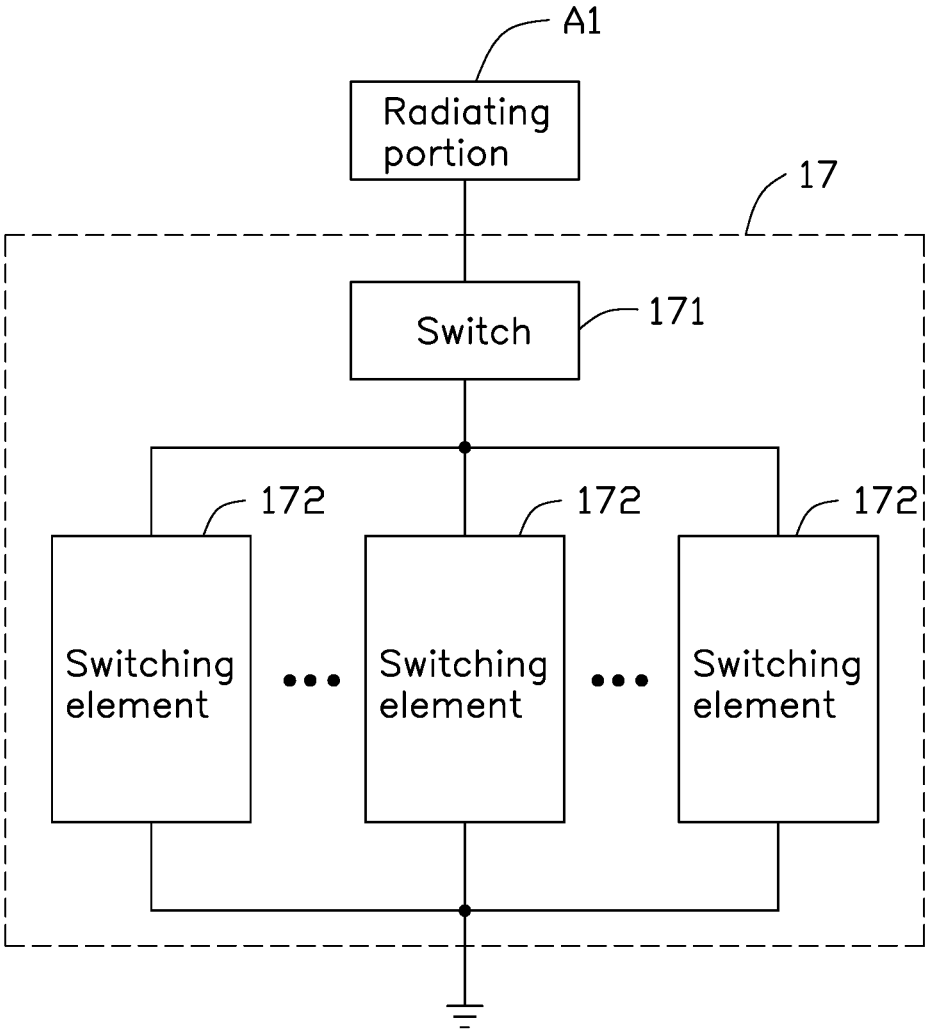
FIG. 4 is a circuit diagram of a switching circuit of the antenna structure of FIG. 2.

FIG. 4 shows, in one embodiment, that the antenna structure 100 further includes a switching circuit 17. The switching circuit 17 is received in the receiving space 113 and positioned between the feeding portion 12 and the electronic element 22. In an embodiment, one end of the switching circuit 17 is electrically connected to the radiating portion A1, and other end of the switching circuit 17 is grounded.

In an embodiment, the switching circuit 17 includes a switch 171 and a plurality of switching elements 172. The switch 171 is electrically connected to the radiating portion A1. Each switching element 172 can be an inductor, a capacitor, or a combination of inductor and capacitor. The switching elements 172 are connected in parallel to each other. One end of each switching element 172 is electrically connected to the switch 171. The other end of each switching element 172 is grounded. The radiating portion A1 can be switched to connect with different switching elements 172 by the switch 171. Since each switching element 172 has a different impedance, the first frequency band of the first operating mode can be effectively adjusted. For example, the switching elements 172 include four inductors, and respective inductance values of the inductors can be 5.1 nH, 10 nH, 12 nH, and 27 nH.

When the feeding portion 12 supplies current, a first portion of the current flows through the radiating portion A1 (per path P1). Thus, the feeding portion 12 and the radiating portion A1 cooperatively activate the first operating mode which generates radiation signals in the first frequency band. A second portion of the current flows through the radiating portion A1, and is then coupled to the first coupling portion A2 through the first gap 118 (per path P2). Thus, the feeding portion 12 and the first coupling portion A2 cooperatively activate the second operating mode which generates radiation signals in the second frequency band. The second coupling portion A3 includes a first end electrically connected to the ground point 13, and a second end positioned at the second side portion 116. The first end is grounded through the ground point 13. The second end is also grounded through the ground point 13. A third portion of the current flows through the radiating portion A1, and is then coupled to the second coupling portion A2 through the second gap 119 (per path P3). A current loop is finally formed through the first end and the second end of the second coupling portion A3. Thus, the feeding portion 12 and the second coupling portion A3 cooperatively activate the third operating mode which generates radiation signals in the third frequency band.

Figure 5:
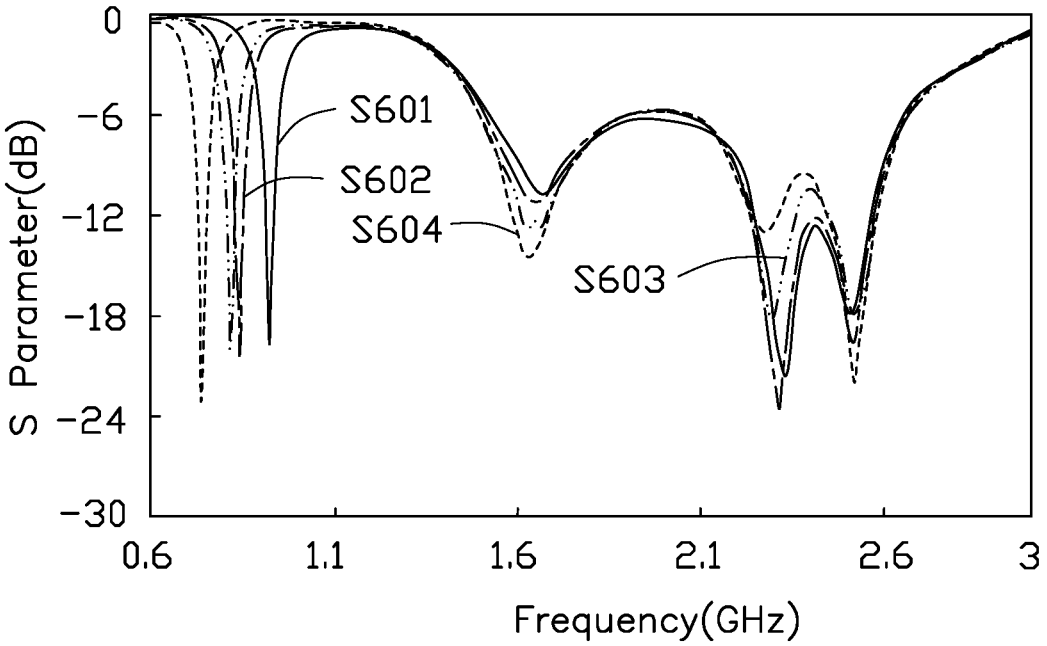
FIG. 5 is a scattering parameter graph of the antenna structure of FIG. 2 when the switching circuit of FIG. 4 is switched to different switching elements.

FIG. 5 is a scattering parameter graph of the antenna structure 100 when the antenna structures 100 works at low, middle, and high modes of the LTE-A. When the switch 171 is switched to the different switching elements 172 (e.g. four different switching elements 172, the respective inductance values of the switching elements 172 being 5.1 nH, 10 mH, 12 nH, and 27 nH, the first band can be effectively adjusted by control of the switch 171 because each switching element 172 has a different impedance. Curve S601 represents a scattering parameter of the antenna structure 100 when the switch 17 is switched to the switching element 172 having an inductance value of 5.1 nh. Curve S602 represents a scattering parameter of the antenna structure 100 when the switch 17 is switched to the switching element 172 having an inductance value of 10 nh. Curve S603 represents a scattering parameter of the antenna structure 100 when the switch 17 is switched to the switching element 172 having an inductance value of 12 nh. Curve S604 represents a scattering parameter of the antenna structure 100 when the switch 17 is switched to the switching element 172 having an inductance value of 27 nh.

Figure 6:
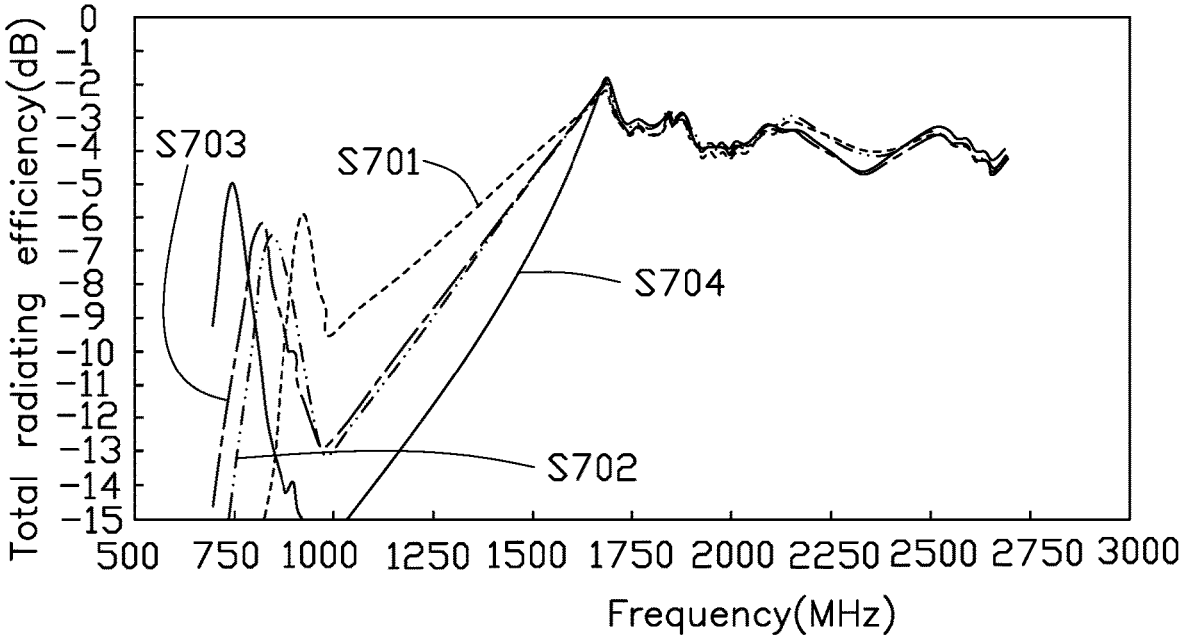
FIG. 6 is a radiating efficiency graph of the antenna structure of FIG. 2.

FIG. 6 is a radiating efficiency graph of the antenna structure 100 when the antenna structures 100 works at low, middle, and high modes of the LTE-A. Curves S701-S704 correspond to respective radiating efficiencies of the antenna structure 100 when the switch 17 is switched to connect with the four different switching elements 172.

For example, curve S701 represents a radiating efficiency when the switch 17 is switched to connect with one switching element 172 having an inductance value of 5.1 nh. Curve S702 represents a radiating efficiency when the switch 17 is switched to connect with one switching element 172 having an inductance value of 10 nh. Curve S703 represents a radiating efficiency when the switch 17 is switched to connect with one switching element 172 having an inductance value of 12 nh. Curve S704 represents a radiating efficiency when the switch 17 is switched to connect with one switching element 172 having an inductance value of 27 nh.

As shown in FIG. 5, the antenna structure 100 can work at the LTE-A low frequency band (e.g. 699 MHz-960 MHz frequency band). In addition, the antenna structure 100 can also work at the LTE-A middle frequency band (e.g. 1710 MHz-2170 MHz) and the LTE-A high frequency band (e.g. 2300 MHz-2690 MHz). Thus, the antenna structure 100 can operate in the low, middle, and high frequency bands. Additionally, when the antenna structure 100 works at these frequency bands, the antenna structure 100 satisfies antenna design requirements and has a relative better radiating efficiency.

As described above, the antenna structure 100 defines the first gap 118 and the second gap 119, then the side frame 112 is divided into a radiating portion A1, a first coupling portion A2, and a second coupling portion A3. The antenna structure 100 further includes the feeding portion 12. When the feed 12 supplies current, the current flows through the radiating portion A1 and is coupled to the first coupling portion A2 and the second coupling portion A3 through the first gap 118 and the second gap 119, thereby activating the first, second, and third operating modes for signals in the first, second, and third frequency bands. In addition, when the current flows through the radiating portion A1, and is coupled to the second coupling portion A3, the first end and the second end of the second coupling portion A3 form the loop current. The first gap 118 and the second gap 119 are both defined in the side frame 112. Thus, the backboard 111 can be made entirely of non-metal material without gaps to obtain a better appearance. The antenna structure 100 can cover multiple frequency bands simultaneously.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a metal frame, the metal frame defining a first gap and a second gap, the first gap and the second gap extending cross the metal frame;

a radiating portion, existing in the metal frame between the first gap and the second gap;

a ground point;

a first coupling portion, existing in a portion of the metal frame extending from a side of the first gap away from the radiating portion;

a second coupling portion, existing in a portion of the metal frame extending from a side of the second gap away from the radiating portion, the second coupling portion comprising a first end coupled to the ground point and a second end coupled to the ground point; and a feeding portion electrically connected to the radiating portion and supplying current to the radiating portion;

wherein when the feeding portion supplies current, the current flows through the radiating portion, and the current is coupled to the first coupling portion through the first gap and the current is coupled to the second coupling portion through the second gap to activate first, second, and third operating modes to generate radiation signals in first, second, and third frequency bands;

wherein when the feeding portion supplies current to the radiating portion, the first end of the second coupling portion and the second end of the second coupling portion to form a current loop.

2. The antenna structure of claim 1, wherein a frequency of the third frequency band is higher than a frequency of the second frequency band, and the frequency of the second frequency band is higher than a frequency of the first frequency band.

3. The antenna structure of claim 1, wherein the first gap and the second gap are all filled with insulating material.

4. The antenna structure of claim 1, wherein the second gap is positioned between the feeding portion and the ground point.

5. The antenna structure of claim 3, wherein the antenna structure further comprises a switching circuit, wherein the switching circuit comprises a switch and a plurality of switching elements, the switch is electrically connected to the radiating portion, the switching elements are connected in parallel to each other, one end of each switching element is electrically connected to the switch, and the other end of each switching element is grounded.

6. The antenna structure of claim 1, wherein the housing further comprises a backboard made of non-metallic material, the metal frame is positioned around a periphery of the backboard to form a receiving space.

7. The antenna structure of claim 1, wherein the metal frame comprises an end portion, a first side portion, and a second side portion, the first side portion and the second side portion are perpendicularly connected to the end portion, the end portion further defines an opening at a middle portion of the end portion.

8. The antenna structure of claim 7, wherein the first gap is positioned between the opening and the first side portion, the second gap is positioned between the opening and the second side portion, the first gap and the second gap are positioned at two sides of the opening.

9. A wireless communication device comprising:

An antenna structure comprising:

a housing, the housing comprising a metal frame, the metal frame defining a first gap and a second gap, the first gap and the second gap extending cross the metal frame;

a radiating portion, existing in the metal frame between the first gap and the second gap;

a ground point;

a first coupling portion, existing in a portion of the metal frame extending from a side of the first gap away from the radiating portion;

a second coupling portion, existing in a portion of the metal frame extending from a side of the second gap away from the radiating portion, the second coupling portion comprising a first end coupled to the ground point and a second end coupled to the ground portion;

a feeding portion electrically connected to the radiating portion and supplying current to the radiation portion;

ground point; wherein when the feeding portion supplies current, the current flows through the radiating portion, and the current is coupled to the first coupling portion through the first gap and the current is coupled to the second coupling portion through the second gap to activate first, second, and third operating modes to generate radiation signals in first, second, and third frequency bands;

wherein when the feeding portion supplies current to the radiating portion, the first end of the second coupling portion and the second end of the second coupling portion to form a current loop.

10. The wireless communication device of claim 9, wherein a frequency of the third frequency band is higher than a frequency of the second frequency band, and the frequency of the second frequency band is higher than a frequency of the first frequency band.

11. The wireless communication device of claim 9, wherein the first gap and the second gap are all filled with insulating material.

12. The wireless communication device of claim 9, wherein the second gap is positioned between the feeding portion and the ground point.

13. The wireless communication device of claim 9, wherein the antenna structure further comprises a switching circuit, wherein the switching circuit comprises a switch and a plurality of switching elements, the switch is electrically connected to the radiating portion, the switching elements are connected in parallel to each other, one end of each switching element is electrically connected to the switch, and the other end of each switching element is grounded.

14. The wireless communication device of claim 9, wherein the housing further comprises a backboard made of non-metallic material, the metal frame is positioned around a periphery of the backboard to form a receiving space.

15. The wireless communication device of claim 10, wherein the metal frame comprises an end portion, a first side portion, and a second side portion, the first side portion and the second side portion are perpendicularly connected to the end portion, the end portion further defines an opening at a middle portion of the end portion.

16. The wireless communication device of claim 15, wherein the first gap is positioned between the opening and the first side portion, the second gap is positioned between the opening and the second side portion, the first gap and the second gap are positioned at two sides of the opening.

* * * * *